United States Patent [19]

Sulc

[11] 4,306,503

[45] Dec. 22, 1981

[54] PROCEDURE FOR AUTOMATICALLY DISPOSING AND FETCHING CARTS AND A DEVICE FOR CARRYING OUT SAID PROCEDURE

[75] Inventor: Pavel Sulc, Täby, Sweden

[73] Assignee: Tellus Maskin AB, Vallentuna, Sweden

[21] Appl. No.: 111,789

[22] Filed: Jan. 14, 1980

[30] Foreign Application Priority Data

Jan. 17, 1979 [SE] Sweden ..... 7900440

[51] Int. Cl.[3] ..... B61J 3/00

[52] U.S. Cl. ..... 104/88; 104/170; 105/26 R

[58] Field of Search ..... 104/26 R, 26 B, 88, 104/170, 171, 287, 288; 105/26 R, 49; 280/423 R, 491 R, 491 A, 477; 180/14 R

[56] References Cited

U.S. PATENT DOCUMENTS

| | | | |
|---|---|---|---|
| 1,424,788 | 8/1922 | Westlake et al. | 280/477 |
| 3,647,014 | 3/1972 | Wilke et al. | 180/14 R |
| 3,828,681 | 8/1974 | Christensen et al. | 104/170 X |
| 3,933,099 | 1/1976 | Sieb | 104/88 |
| 4,106,636 | 8/1978 | Ouimet et al. | 104/88 X |

*Primary Examiner*—Randolph A. Reese

*Attorney, Agent, or Firm*—Silverman, Cass & Singer, Ltd.

[57] ABSTRACT

Procedure for automatically disposing and fetching transport carts and a device for carrying out the procedure is disclosed. The carts preferably are non-driven and are intended to be moved by an electrically driven traction truck. The carts are also intended to be disposed automatically and in a given order on a disposition area, in a row, adjacent one another. The carts are to be automatically fetched from the disposition area in arbitrary order. During fetching of a cart, the traction truck is directed relative to a cart for the coupling of the traction truck to a coupling gear on the cart so that the truck and cart are brought into position for coupling together without the need for the traction truck to make any backward movement. The traction truck is aligned so that its longitudinal direction at the coupling position is substantially perpendicular to the longitudinal direction of the cart. Further, the traction truck that is coupled to the cart before and/or in connection with a removal of the cart from the row of carts first is turned without any backward movement, so that its longitudinal direction coincides approximately with the longitudinal direction of the cart, after which the traction truck completely removes the cart from the row of carts.

4 Claims, 4 Drawing Figures

1
2
3
5
6
7
8
9
10
11
12
13
14

1
3
4
17
38

PROCEDURE FOR AUTOMATICALLY DISPOSING AND FETCHING CARTS AND A DEVICE FOR CARRYING OUT SAID PROCEDURE

BACKGROUND OF THE INVENTION

The present invention relates to a procedure for automatically disposing and fetching carts and a device for carrying out said procedure, for example with carts carrying goods in factory buildings or the like.

In, for example, the engineering industry it very often occurs that stock such as raw materials, unworked details and finished details are transported in large lots on carts between different stations, such as raw material stocks, intermediate stocks, working stations and finished products stocks.

In, for example, large forging plants forgings are intermediately stocked on carts. One cart at a time is taken to the desired working station, for example, a forging press and empty carts and carts with worked details are fetched or are gone after and returned with.

The transport of the carts may be done manually or with the aid of a traction truck. A solution that has been used more often uses automatic traction trucks which, for example, are directed by loops in the floor. With the aid of a well designed system of this type it is possible to automatically transport carts for the described purposes in a desired way inside a plant. In a well functioning transport system of the said type it is very important that the disposing or placement of the carts in a certain order or alignment and the fetching of carts at the different stations may be done automatically and reliably.

An automatic, intermediate stock station centrally positioned in a plant is, for example, arranged in such a way that the carts are positioned in a row next to one another with their longitudinal directions parallel to each other and their longitudinal directions at right angles to the longitudinal direction of the row of carts. During disposition the traction truck and the cart are driven at a right angle to the row of the carts and the traction truck passes through the row of carts before the placement of the cart and before it is stopped and is disconnected from the pulled cart so that the pulled cart is disposed at the desired position in the row.

However, the automatic fetching of carts disposed in this manner has associated problems. During a fetching operation, preferably, the back part of the traction truck should be brought near the front part of the disposed cart in order for a coupling to be performed by a coupling arrangement of which one part is situated on the traction truck and another part is situated on the cart. During such a coupling, the demands on precision are high because the system is automatic and the coupling together must be done with a very high reliability of operation. Further the cart after the coupling to the traction truck must be pulled out from the row of carts essentially at a right angle to the row and parallel to the other carts because the cart with its load must not come into contact with adjacent carts or the loads on those carts. The carts are disposed rather near one another as usually the smallest possible size of the disposition area is desired.

One solution would be to move the traction truck backwards to a coupling position relative to the cart to be fetched, or corresponding to the truck position at the disposition of the cart. With a loop-directed traction truck however, such a well controlled backing movement as is needed, unfortunately, is very difficult or impossible to provide.

The present invention relates to a procedure which solves the abovementioned problems and where the need for unacceptable backing movements has been eliminated.

SUMMARY OF THE INVENTION

In accordance with the invention there is provided a procedure and a combination for disposing and fetching carts which are non-driven and which are to be moved by a self-propelled traction truck. The carts are automatically and in a given order disposed on a disposition area in a row adjacent one another and are automatically fetched from the disposition area in another given order independent of the order in which they were disposed. The traction truck is driven along the row of carts perpendicular to the longitudinal axis of the carts to a coupling position at which the traction truck is coupled to one cart. The traction truck then makes a sharp turn in a direction away from the carts and a second turn in an opposite direction in a path shaped as an "S" to align the longitudinal axes of the traction truck and cart. The traction truck then removes the cart from the row and out of the disposition area with the cart being free of touching any other cart in the row. The traction truck is moved essentially only in the forward direction and the coupling means between the traction truck and cart are such that no backward movement of the traction truck is required.

BRIEF DESCRIPTION OF THE DRAWING

In the following, an embodiment of the invention will be described in connection with the annexed drawings, where.

DESCRIPTION OF THE PREFERRED EMBODIMENT

Figure 1:
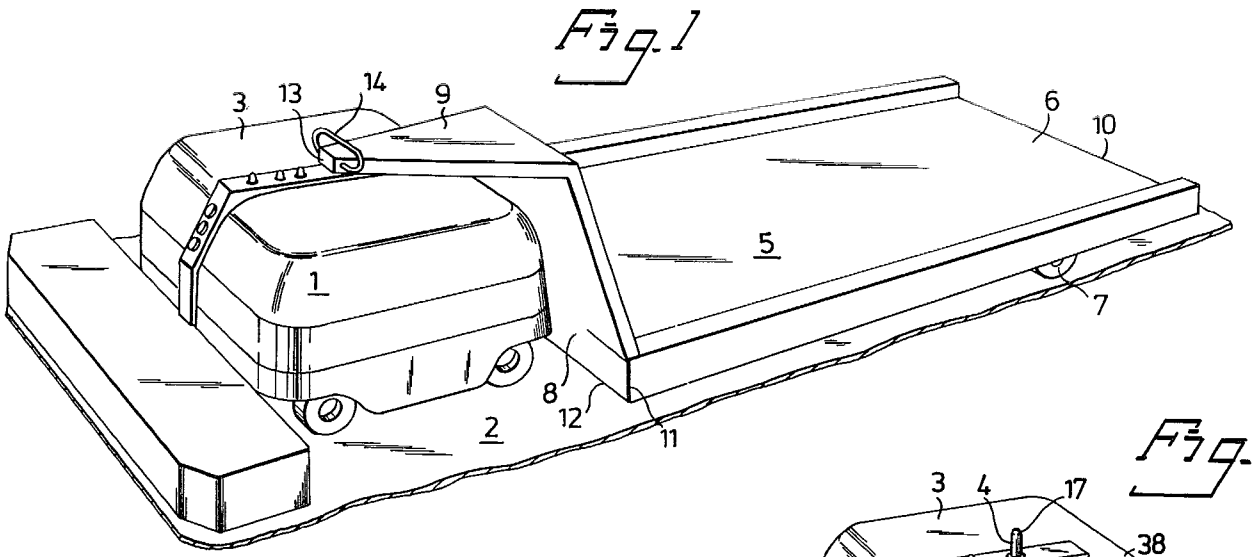
FIG. 1 is a perspective view of a preferred embodiment of a traction truck coupled to a cart to be used in one application of the invention.
Figure 2:
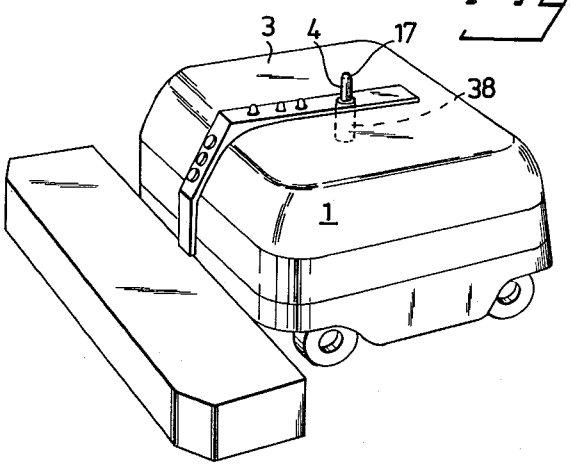
FIG. 2 is a detailed perspective view of a traction truck according to FIG. 1 but without a cart coupled to the same.

In FIG. 1 a preferred embodiment of a traction truck intended to enter into a loop controlled transport system of the type described here is referred to as 1. The traction truck 1 is unmanned, electrically driven or self-propelled and arranged to be directed in a known way by a loop in or on a surface 2, for example a plant floor, on which the traction truck is driven and which has been schematically shown in FIG. 1. The traction truck is provided with a coupling means, as is shown in FIG. 2, on its upper side 3, preferably at the center of said upper side 3 and on the center line of said upper side 3 in the longitudinal direction of the traction truck 1. This coupling means consisit of a vertical rod 4, which is arranged or able to be raised and lowered. The rod 4 may for instance be the piston rod of a hydraulic cylinder of a known type arranged inside the traction truck. The rod 4 is intended to be lowered so far that it does not substantially protrude above the upper side 3 of the traction truck. In FIG. 2 the rod 4 is shown in a position which the rod occupies when a cart is coupled to the traction truck 1.

In FIG. 1, reference character 5 denotes a preferred embodiment of a cart intended for transport of goods and to be pulled by the traction truck 1. The cart 5 includes essentially a rectangular load plane or bed 6, a pair of wheels 7 with a stationary shaft at right angle to the cart's longitudinal direction, and a front with an essentially vertical part 8 tilted somewhat outward and forward from the load plane 6 and a part 9 which is essentially horizontal and directed forward of the cart.

The wheels 7 are situated under the cart and nearer to the back end 10 of the cart than to the front end 11 and thus the cart when standing free is resting on the surface 2 by its wheels 7 and its forward lower edge 12.

The front parts, 8 and 9, of the cart are fixed to the front end 11 as desired and consist, for example, of a plate of a suitable thickness. The plate is bent in such a way that when the plate is fixed to the essentially horizontal load plane 6 it will form the nearly vertical part 8 and the essentially horizontal and forward directed part 9. The plate before being bent has the shape of a parallel trapezoid in its main dimension plane, that is in the plane normal to the thickness of the plate. The shape is further such that the non-parallel sides are equally long. The parallel side 12 that connects to the forward end 11 of the cart is about as long as the fore load plane edge and the parallel side 13 that consitutes the free end of the horizontal part 9 is about a decimeter long.

The front may be thought of as being assembled from several parts without the characteristic shape and with the horizontal protruding part 9 being changed appreciably.

Figure 3:
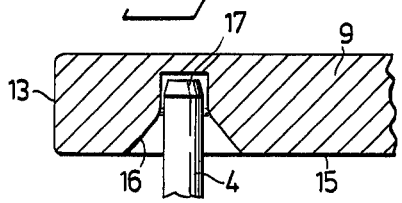
FIG. 3 is a sectional view of an embodiment of a coupling gear for coupling together a traction truck and a cart.

In connection with the free end 13 there is a handle 14 for manual movement of the cart. In connection with the free end 13 there is also, as is shown in FIG. 3, a coupling means on the underside 15 of the horizontal part arranged to cooperate with the rod 4 on the traction truck 1. The coupling means of the cart 5 consist of a conical, essentially vertical hole 16 tapering inwardly from the underside 15 of the horizontal part 9. The end 17 of the rod 4 is conically shaped in order to facilitate engagement in the hole 16. The conical part of the hole 16 may be completed by, for instance, a funnel on the underside 15 of the horizontal part 9 in order to further facilitate engagement.

The shape of the cart 5 that has been described provides for the traction truck, after coupling to the cart, to be able to be turned considerably relative to the cart and for the cart, when disposed, to be very difficult to move, that is it will maintain the position in which it originally was disposed.

Figure 4:
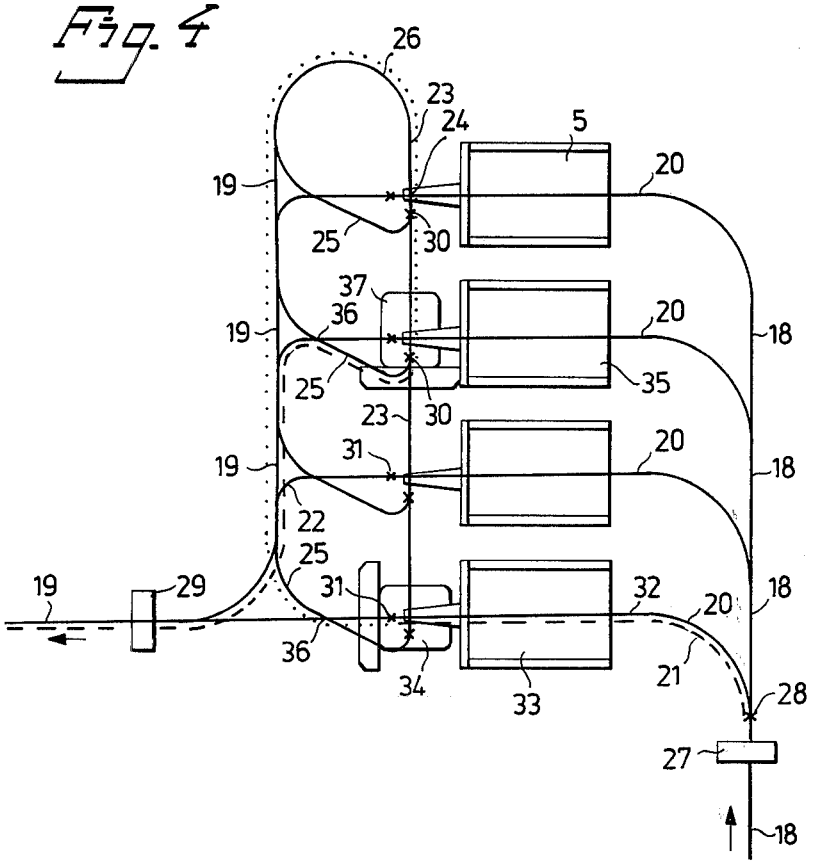
FIG. 4 is a schematic plan view of a preferred embodiment of a disposition area for application of the invention, with among other things traction trucks, carts and loops for the directing of traction trucks.

In FIG. 4 there are schematically shown loops in or on the surface 2 and by such loops the traction trucks 1 will be directed in a known way by signals. FIG. 4 shows a preferred embodiment of a loop system for a disposition area of the described type of carts 5. One loop 18 is an entry loop to the disposition area and one loop 19 is an exit loop from the disposition area. One part of the loop 18 and one part of the loop 19 are situated within the disposition area and in the disposition area are essentially straight and parallel to one another at a given distance from one another. Between and mainly at a right angle to these loops there are a number of loops 20 constituting blind tracks. Each blind track loop 20 is a disposition position for a cart 5. In FIG. 4 there are four blind track loops 20 shown. Each blind track loop 20 is at its one end smoothly connected to the entry loop 18 by means of a 90°-curve 21 and at its other end smoothly connected to the exit loop 19 by means of a 90°-curve 22.

Within the disposition area there is also a loop 23 running parallel to and between the loop parts 18 and 19 on the "exit" side of the carts 5 in the disposition area. The loop 23 thus crosses the blind track loops 20.

In connection with each such crossing 24, there is a departure loop 25 arranged immediately after the crossing in a direction in which a traction truck is intended to be driven along the loop 23. The departure takes place towards the "exit side" and the loop 25 runs in a curve that preferably is greater than 90° and will thus cross a blind track loop 20 and is smoothly connected to the loop part 19 within the disposition area.

The loop 23 terminates in such a departure loop 25 at the end that is nearest to the entry to the disposition area and is, at its other end, connected to the loop part 19 by means of a 180°-curve 26.

In the entry loop 18 and before the first curve 21, which is the departure to the first blind track 20, there is in the entry direction firstly a receiver 27 and after this receiver a stop 28. In the exit loop 19 there is outside the disposition area a receiver 29.

A stop 30 is also provided in the loop 23 immediately after each crossing 24 in the direction in which a traction truck 1 is intended to be driven along the loop 23. A stop 31 is also provided in each blind track 20 immediately after each crossing on the "exit side" of the crossing 24.

Said stops may for instance be constituted by a metal plate arranged in or on the said surface. By means of, for instance, a sensing device in the traction truck with said sensing device being actuated by the metal plate, the driving arrangement for the traction truck is disconnected and the traction truck stops. The sensing device may, for instance, be of an inductive type.

The disposing and fetching of carts 5 is done in the following manner. The functions described in the following require a direction and control system. This is of a known type and will preferably include a computer. Said direction and control system will not be described in detail here. The said direction and control system will provide what here has been characterized as "automatic control".

When a cart 5 is to be disposed this cart and a traction truck are driven along the entry loop 18 outside the disposition area. By means of the receiver 27 the said control system will record the arrival of the traction truck 1. The receivers 27 and 29 are arranged and supervised by the control system in such a way that the traction truck is stopped at the stop 28 if there is a traction truck between the receivers 27 and 29. In the loop 18 the traction truck is controlled in a known way by a signal with a frequency $f_1$. The signal with the frequency $f_1$ has in FIG. 4. been marked by a dashed line alongside the actual loop. If there is no traction truck 1 between the receivers 27 and 29, the said control system will "fire" a signal with the frequency $f_1$ along only the blind track 32 that includes the desired and free disposition space or position for the cart, and this cart has in FIG. 4 been referenced character as 33. The traction truck has the reference 34. The signal with the frequency $f_1$ is present up to the stop 31 in the blind track loop 32. The traction truck is now driven until it is brought to a stop at the stop 31. The traction truck 34 and the cart 33 will now have the positions shown in FIG. 4, and for the cart 33 this is the desired disposition. Here the coupling means 4,17 and 16 on the traction truck and the cart respectively are substantially vertically above the crossing 24. The rod 4 will thereafter automatically be lowered so that it no longer engages the hole 16, and then the traction truck and the cart will be disconnected from each other. Hereby the front of the cart is lowered and rests on the wheels 7 and its fore edge 12. The cart 33 has thus been disposed at the desired position.

When the traction truck after disposition of the cart 33 is to fetch a cart 35 from the disposition area the traction truck is automatically switched to follow, that is to be directed and controlled by a signal with a frequency $f_2$. A signal with the frequency $f_2$ is present in that part of the blind track loop 32 that is situated between the stop 31 and the crossing 36 between the blind track loop 32 and the departure loop 25. A signal with the frequency $f_2$ is in FIG. 4 indicated by a dotted line along the actual loop. A signal with the frequency $f_2$ is also present along the part of the departure loop 25 that is situated after the crossing 36, along the loop part 19, along the curve 26 and along the loop 23 up to the stop 30 associated with the cart 35 to be fetched.

The traction truck, which in this case is referenced as 37, is thus before being coupled to the cart 35 driven parallel to the row of the disposed carts 5. Before the coupling together of the traction truck and the cart the traction truck 37 is driven in under the horizontal part 9 of the cart 35 to a coupling position. The position of the stop 30 is chosen in such a way that the traction truck will be brought to a stop when the rod 4 is vertically below the hole 16 in the part 9, that is vertically above the crossing 24. To couple together the truck and cart, the rod 4 is automatically raised so that it engages the hole 16. The rod is raised at least so much that the fore edge 12 of the cart no longer rests on the surface 2. After coupling together, a signal with the frequency $f_1$ is provided in the departure loop 25 beginning at the stop 30 and being present to the crossing 36, and the traction truck will also automatically be switched to follow the signal with the frequency $f_1$. Additionally a signal with the frequency $f_1$ is provided in parts of the blind track loop 20 and the exit loop 19 as shown in FIG. 4, and the traction truck 37 with the cart 35 exits from the disposition area.

The departure loop 25 and the part of the blind track loop 20 that is between the crossing 36 and the exit loop 19, are shaped in such a way that the traction truck, after being coupled to a cart will pull out the cart from the row of carts and, will move in a path shaped as an "S". The traction truck thus will immediately after the coupling to the cart and its starting movement make a sharp turn which preferably is greater than 90°. This movement pattern for the traction truck provides for the cart to make only very limited turning movements. The cart and its load will be pulled out nearly at a right angle to the row of the carts and without such great turning movements that could bring the cart into contact with adjacent carts or their loads even if the carts are arranged rather near one another in the row, i.e. the cart will be free of touching any other cart.

The traction truck will pass the receiver 29 when leaving the disposition area and this is recorded by the said receiver and thereafter another traction truck is allowed to pass into the disposition area.

By means of the fetching procedure that has been described, carts are fetched from a row of carts without any backward movement, that is the coupling means 4,17 and 16 are brought into position for coupling without any backward movement of the traction truck being needed. The coupling means 4,17 and 16 are thus brought into coupling position by driving the traction truck forward and parallel to the row of carts and bringing it to a stop when said position has been reached. The hole 16 is then positioned vertically above the rod 4. In order that the cart will be pulled essentially straight out from the row of carts the traction truck is thereafter turned, still without any backward movement, so that the longitudinal direction of the traction truck is turned to coincide with the longitudinal direction of the cart. The traction truck may also be turned wholly or partly before the coupling together.

An embodiment of a procedure according to the invention and arrangements for carrying out the procedure have been described. Of course several modifications and alternative embodiments are possible. The movable part of the coupling means, that is the rod 4, may be placed on the carts 5 and the hole 16 on the traction truck, with the rod 4 thus pointing downward. Coupling means of other kinds may also be used if they fulfil the requirements that are put on them.

Further of course a horizontal protruding part corresponding to the part 9 on the carts may be placed protruding rearwards on the traction truck instead of on the carts. The carts will then at their forward end have an eye or the like and the rod 4 will preferably be placed in the free end of the protruding part of the traction truck. In order to attain a position for coupling, the traction truck is sharply turned, as already has been described, away from the row of carts so that the horizontal protruding part is turned towards the eye to a coupling position.

The loop 23 may be made in several manners so that the traction truck at the coupling together for fetching has a position with its longitudinal direction essentially at right angle to the longitudinal direction of the cart. Further technical equivalents to said loop, such as optical loop systems, may be used wihout leaving the inventive concept.

The invention thus must not be considered to be limited to the shown embodiment but may be varied within the scope of the attached claims.

I claim:

1. A procedure for automatically disposing and fetching carts, the carts being non-driven and intended to be moved by a separate self-propelled traction truck, the procedure being such that the carts are automatically and in a given order disposed on a disposition area in a row laterally adjacent one another and are automatically fetched from the disposition area in another given order which may be independent of the order in which they were disposed, comprising:

providing coupling means on said carts and said traction truck, said coupling means including a first part provided on the traction truck approximately at the center of a center line on the upper side of the traction truck extending along the longitudinal axis of the traction truck, and a second part provided on the underside of a horizontal part of the cart extending out in front of the cart, said first and second parts being engagable one into the other to couple the carts and traction truck together;

moving the traction truck relative to one cart by moving the traction truck essentially only in the forward direction so that the coupling means first and second parts are vertically aligned with the longitudinal direction of the traction truck being essentially perpendicular to the longitudinal direction of the cart;

coupling the cart and traction truck together by engaging the first part and second part one into the other; and removing the cart from the disposition area free of touching any other cart by driving the traction truck essentially only in a forward direction to make a first turn in a direction away from the cart and thereafter to make a second turn in an opposite direction to describe a path shaped as an "S" so that the longitudinal axis of the traction truck is turned to coincide with the longitudinal axis of the cart and the traction truck then pulling the cart out of the disposition area.

2. A combination for automatically disposing transport carts in a given order on a disposition area in a row laterally adjacent one another, and automatically fetching the carts from the disposition area in another given order which may be independent of the order in which they are disposed, comprising:

said transport carts each having a front, a longitudinal axis and being non-driven;

a traction truck which is self-propelled, the traction truck having a longitudinal axis and being driven essentially only in a forward direction, the traction truck having an upper side and a center line on the upper side extending along the longitudinal axis thereof;

coupling means provided on said carts and the traction truck to couple a cart and traction truck together, and coupling means including a rod provided on the traction truck at the center of the center line, the rod being vertically arranged;

a surface upon which the carts and truck may be moved;

first loop means carried by the surface for directing the essentially forward movement of the traction truck, the first loop means being parallel to said row of carts and perpendicular to the longitudinal axis of the carts on the front side of the carts, so that the traction truck when fetching a cart is directed along the first loop means to a coupling position in which the coupling means on the cart and traction truck are coupled with one another and the longitudinal axis of the traction truck is essentially perpendicular to the longitudinal axis of the cart;

departure loop means carried by the surface for directing the essentially forward movement of the traction truck, the departure loop means commencing just past the coupling position in the direction of movement of the traction truck along the first loop means and making a sharp turn of about more than 90° in a direction away from the row of carts; and loop section means carried by the surface for directing the essentially forward movement of the traction truck, the loop section means connecting to the departure loop means after the sharp turn and making a turn in a direction opposite of the sharp turn, the coupling means being such that the traction truck coupled to the cart will make a turning movement so that the longitudinal axes of the traction truck and cart will coincide and thereafter the traction truck which is coupled to a cart from the coupling position will be directed along the departure loop means and loop section means in a path shaped as an "S" to remove the cart coupled thereto from the row of carts free of touching any other cart.

3. The combination as claimed in claim 2 in which the cart includes only one pair of wheels carried on a stationary shaft aligned perpendicular to the longitudinal axis of the cart, the wheels being arranged under the cart and nearer the rear of the cart than the front so that the cart when free of the traction truck rests on the surface by its wheels and a lower front edge.

4. The combination as claimed in claim 2 in which the rod is the piston of a hydraulic cylinder which is raised to couple the traction truck to the cart and is lowered to uncouple the traction truck from the cart, and the cart includes a horizontal part extending forward of the cart and including a hole for receiving the rod.

* * * * *